US006412412B1

(12) United States Patent
Michaud et al.

(10) Patent No.: US 6,412,412 B1
(45) Date of Patent: Jul. 2, 2002

(54) DEVICE AND METHOD FOR CONTROLLING INK KEYS

(75) Inventors: Dennis Normand Michaud, Somersworth; Michael Raymond Rancourt, Merrimack, both of NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/535,938

(22) Filed: Mar. 24, 2000

(51) Int. Cl.[7] ..... B41F 31/02
(52) U.S. Cl. ..... 101/365; 101/367
(58) Field of Search ..... 101/365, 367, 101/484, 485

(56) References Cited

U.S. PATENT DOCUMENTS 4,713,593 A * 12/1987 Rodi et al. ..... 101/365
5,138,944 A * 8/1992 Rancourt et al. ..... 101/365
5,664,101 A * 9/1997 Picache ..... 101/183
5,799,579 A * 9/1998 Schlegel ..... 101/365
5,867,049 A * 10/1999 Seymour et al. ..... 101/484
6,009,808 A * 1/2000 Loffler ..... 101/211
6,024,018 A * 2/2000 Darel et al. ..... 101/365
6,142,078 A * 11/2000 Lachajewski ..... 101/484

* cited by examiner

*Primary Examiner*—Kimberly L. Asher
(74) *Attorney, Agent, or Firm*—Davidson, Davidson & Kappel, LLC

(57) ABSTRACT

An ink key control system comprises a data processor, a local area network connected to the data processor, and a plurality of ink keys connected directly to the local area network. Each of the plurality of ink keys includes a protocol controller for receiving an input from the local area network and a setpoint controller for receiving an input from the protocol controller. Also provided is a method for setting ink keys in a printing press comprising the steps of determining a desired setpoint for an ink key, transmitting the desired setpoint over a LAN to the ink key, receiving the desired setpoint at the key, and setting the key as a function of the desired setpoint.

9 Claims, 2 Drawing Sheets

DEVICE AND METHOD FOR CONTROLLING INK KEYS

BACKGROUND OF THE INVENTION

1. Field of the Invention

The present invention relates generally to printing presses and more particularly to a device and method for controlling ink keys.

2. Background Information

U.S. Pat. No. 4,986,180 purports to disclose a device for controlling the opening of an ink fountain of a printing machine. A plurality of side-by-side lamellae or keys control how much ink is delivered to an ink roller by altering the distance between the lamella edge and the ink roller. Each key has a drive module, which has a control means, an amplifier, a drive unit, and an axle connected between the drive unit and the lamella. The control means may be a printed circuit board containing a processor and which receives signals from a bus line. The control unit accepts pulse signals, which the control means converts to control impulses for the amplifier. The amplifier converts the control impulses to into electrical power to switch on the drive unit which moves the axle to control the lamella. A detector is also provided to detect the location of the lamella and feed this location back to the control means.

All of the drive modules are connected through bus lines to a pre-amplification and interface unit. The bus lines have a plurality of extending parallel bus lines or wires and each of the control units is connected in parallel to every one of the wires. The pre-amplification and interface units are in turn connected to electronic data processing means which may be connected to a microcomputer or microprocessor in which an operator is able to communicate and operate by use of a keyboard and a screen.

U.S. Pat. No. 4,986,180 has the drawback that a separate bus line or wire is required for each drive module. The bus lines must often run through an electrically noisy environment and the large number of wires or lines in the bus can cause or be subject to electrical interference, resulting in malfunction of the control operations. Moreover, if a large number of keys are desired, the number of wires becomes large and the connections complication. In addition, the use of the pre-amplification and interface unit requires several connections, which are often the cause of malfunction or error. The described pulse control system also may not be highly accurate.

U.S. Pat. No. 5,052,298 describes an ink control system comprising a system CPU connected by serial lines to four servo power units, each power unit being connected to a plurality of server banks with servo modules, each servo module for adjusting one of the keys. Each servo power unit thus has a plurality of outputs for controlling different server banks. An operator console is connected to the system CPU via 24 discrete bus lines. The system described has several disadvantages including the large amount and type of wiring necessary.

BRIEF SUMMARY OF THE INVENTION

An object of the present invention is to provide a reliable ink key control system. An alternate or additional object of the present invention is to provide an ink key control system with simplified wiring.

The present invention provides an ink key control system including a data processor, a local area network connected to the data processor and a plurality of ink keys connected directly to the local area network, each of the plurality of ink keys including a protocol controller for receiving an input from the local area network and a set point controller for receiving an input from the protocol controller.

Since each key of the present invention has a protocol controller and is directly connected to the local area network (LAN), a simplified and reliable key control system can be created. In particular, the amount of wiring can be reduced, and failure of a controller results in only a single key failure, rather than failure of a larger number of keys. The ink keys may further include an I/O driver for receiving an input from the setpoint controller, and a motor driven by the I/O driver. The motor can move to set a key blade for delivering a specific ink thickness from an ink fountain to an ink roller. The motor can be connected to a potentiometer which provides a feedback voltage depending on the position of the potentiometer, the feedback voltage being sent to an A/D converter. Alternatively a counter may be used to monitor the motor position. The A/D converter can output a digital value to the setpoint controller, which can then transmit this information in proper protocol form over the LAN. All of the electronics for a single key, including the protocol controller, setpoint controller, I/O driver and A/D converter, can be contained in a single key. The motor and pot, as well as the key blade, can be contained in the key as well.

Thus a plurality of discrete keys can be connected directly to the LAN, reducing wiring and improving reliability.

The LAN can be a commercial LAN such as PROFIBUS. The LAN communications protocol preferably incorporates a requested setpoint for a particular web, web side, color and key. The protocol controller determines when a message is for the protocol controller's specific key and strips out the setpoint from the setpoint request. The setpoint is sent to the setpoint controller, which reads the setpoint request. The setpoint request is then compared to the actual setpoint, a direction of necessary movement is determined (if any), and the key is moved using the I/O driver to the setpoint using feedback from the motor through the potentiometer and the A/D converter.

A control algorithm of the setpoint controller ensures that the ink key motor is set within a certain set point window. The I/O driver switches the motor on and off. Changing the voltage polarity to the motor changes the motor direction. The potentiometer feedback is converted by the A/D converter to a digital value so that the setpoint controller can compare the actual position of the motor to the requested set point. Once the requested set point is within the setpoint window, the I/O driver can turn the motor off.

The key electronics may be driven by low power voltage, for example, 12 volts DC.

The present invention also provides a modular ink key comprising a housing and a LAN protocol controller, a setpoint controller, an I/O driver, and a motor inside the housing. The modular arrangement of the ink keys permits easy replacement as well as permitting simple connection to a LAN.

A method for setting ink keys is also provided comprising the steps of:

determining a setpoint for an ink key;

transmitting the setpoint over a LAN to the ink key, receiving the setpoint at the key, and setting the key as a function of the setpoint.

Preferably, the method also includes feeding back an actual position of the key to a setpoint controller. The setpoint is transmitted in a LAN protocol, which may be received by a protocol controller at the ink key.

BRIEF DESCRIPTION OF THE DRAWINGS

One embodiment of the present invention is described below by reference to the following drawings, in which.

DETAILED DESCRIPTION

Figure 1:
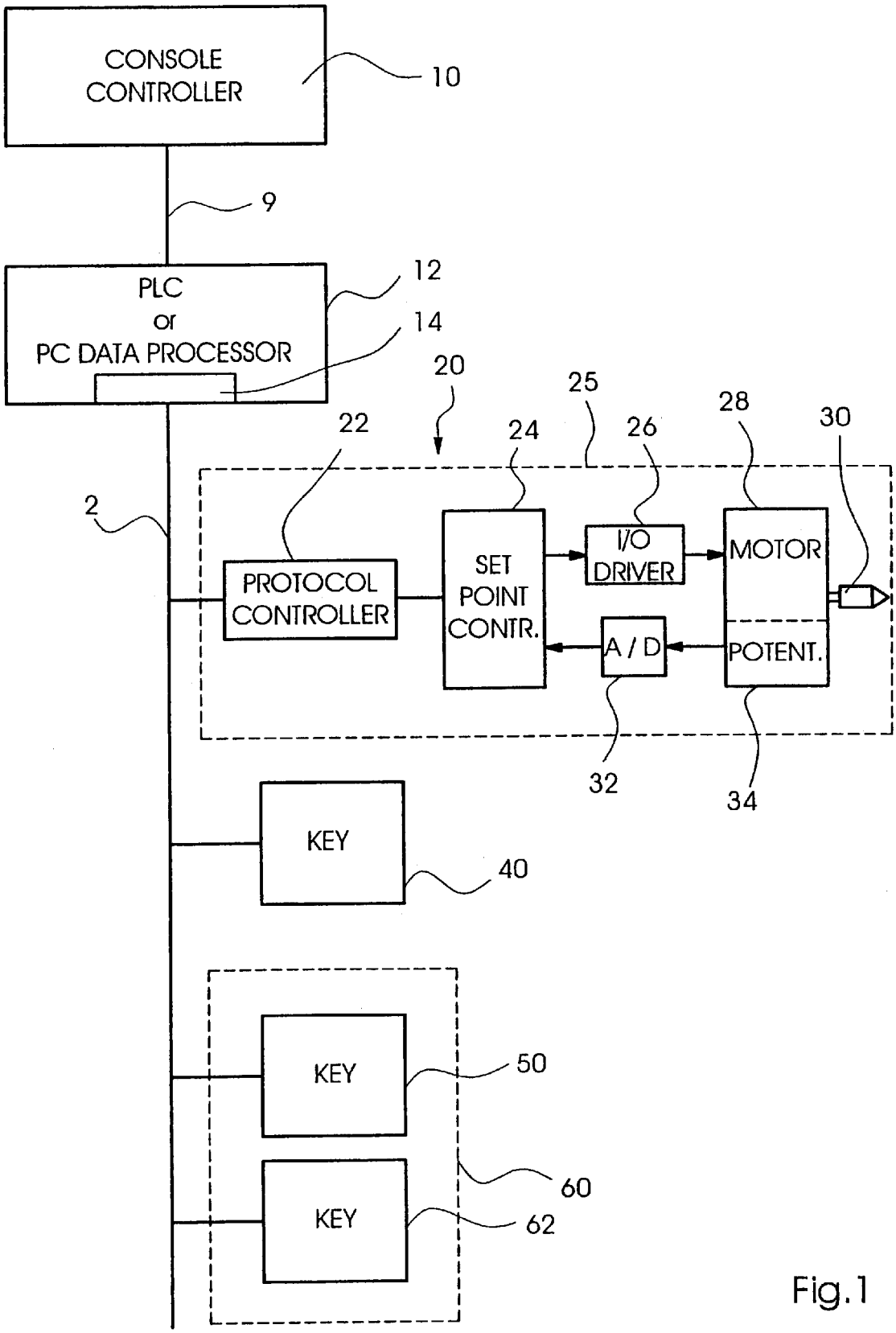
FIG. 1 shows a schematized view of the ink key control system of the present invention.

FIG. 1 shows a programmable logic controller (PLC) or PC 12 which an operator can control, for example through a console controller 10 connected to the PLC 12 by a serial link 9, to set ink delivery for a plurality of ink keys in a printing press. The ink delivery alternatively could be controlled by an algorithm as a function of print quality of outputted printed products.

A data processor, which could be part of the PLC 10, can receive desired ink delivery data from PLC 12 and calculate desired setpoints for each of the keys of the printing press as a function of the desired ink delivery. The setpoints for the various keys can then be delivered by a communications driver 14, the setpoints being embedded in a LAN communications protocol to be sent over a LAN 2. The LAN communications protocol may vary according to the type of LAN used, but each key can be represented as a particular number, along with which a key setpoint is sent. The protocol also may be such that a key is identified by first identifying a particular web, then a web side, then a color and then the key for that color. For example a set of keys 62 including keys 50 and 60 may be assigned to a particular ink roller for a particular color for a web side of a particular web. This key identifying information may be sent along with the setpoint for that particular key. An example of a LAN for use herewith is a PROFIBUS-compatible LAN or a CAN.

Figure 2:
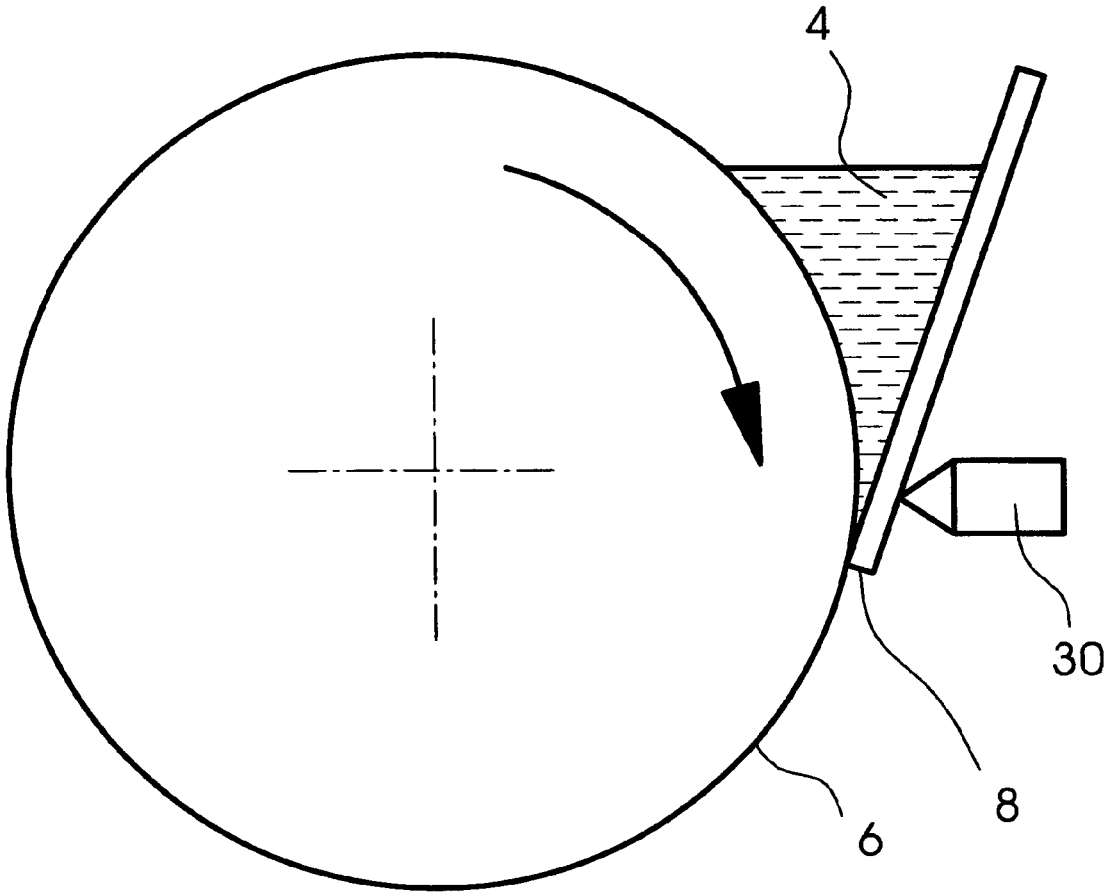
FIG. 2 shows a schematized side view an ink roller with a controlled inking blade.

LAN 2 is connected directly to each of the keys 20, 40, 50, 60 of the printing press, all of which are of similar construction and include a housing, such as housing 25 for key 20. Key 20 shows details of each key. LAN 2 first connects to a protocol controller 22 of key 20. Protocol controller 22 receives the LAN signals and if a signal for key 20 is received, protocol controller 22 strips out the setpoint information and transfers the setpoint information as digital data to a setpoint controller 24. Setpoint controller 24 controls the on/off status of a motor 28 through an I/O driver 26. Motor 28 moves a blade setting device 30, which as shown in FIG. 2 controls the distance a blade 8 is from an ink roller 6. The thickness of ink from an ink fountain 4 as applied to roller 6 thus can be controlled. It is understood that a plurality of blades 8 are arranged axially along the ink roller 6.

As shown in FIG. 1, setpoint controller 24 receives an input from an A/D converter 32 which receives information about the actual position of blade setting device 30 through a potentiometer 34. Potentiometer 34 sends a voltage signal to A/D converter 32, which is converter there to a digital value which is input to the setpoint controller 24.

Key 20 thus is set to the desired setpoint by setpoint controller 24 as follows. The desired setpoint received from protocol controller 22 is compared to the current actual setpoint received from potentiometer 34 through A/D converter 32. If a move is necessary, a move direction is first determined, i.e. whether blade setting device 30 must move toward or away from ink roller 6.

As a function of the move direction, I/O driver 26 is turned on to produce a positive or negative voltage to motor 28, a negative voltage moving blade setting device 30 one direction, a positive voltage moving blade setting device 30 in the opposite direction.

The movement of blade setting device 30 is fed back by potentiometer 34 and A/D converter 32 to setpoint controller 24, which turns off motor 28 when the setpoint is reached. Different feedback algorithms may be used by setpoint controller 24 depending on the accuracy desired by the system, with the setpoint preferably being reached within a certain time window.

It should be understood that the protocol controller and setpoint controller may be contained in single circuitry, for example an ASIC.

The actual key position as determined by the potentiometer can also be transmitted over the LAN 2 by the protocol controller, so that this information is available at the PLC or PC 12.

What is claimed is:

1. An ink key control system comprising:

a data processor, a local area network connected to the data processor, and a plurality of ink keys connected directly to the local area network, each of the plurality of ink keys including a protocol controller for receiving an input from the local area network and a setpoint controller for receiving an input from the protocol controller.

2. The ink key control system as recited in claim 1 wherein each ink key further includes an I/O driver for receiving an input from the setpoint controller.

3. The ink key control system as recited in claim 2 wherein each key further includes a motor driven by the I/O driver.

4. The ink key control system as recited in claim 3 wherein each key further includes a blade setting device driven by the motor.

5. The ink key control system as recited in claim 1 wherein each key includes a housing for housing the protocol controller and the setpoint controller.

6. The ink key control system as recited in claim 1 wherein each key further includes a potentiometer providing a feedback to the setpoint controller.

7. The ink key control system as recited in claim I wherein the local area network has a protocol for transmitting setpoint information to a specific key of the plurality of keys.

8. The ink key control system as recited in claim 7 wherein the protocol includes information on web, web side, and color for the specific key.

9. A modular ink key comprising:

a housing, a LAN protocol controller for receiving inputs from a LAN, a setpoint controller for receiving inputs from the LAN protocol controller, an I/O driver connected to the setpoint controller, and a motor controlled by the I/O driver, the LAN protocol controller, the setpoint controller, the I/O driver and the motor being housed within the housing.

* * * * *